US006708664B2

(12) United States Patent
Ito

(10) Patent No.: US 6,708,664 B2
(45) Date of Patent: Mar. 23, 2004

(54) AUXILIARY EQUIPMENT IN AN ENGINE

(75) Inventor: Shoji Ito, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 65 days.

(21) Appl. No.: 09/683,528

(22) Filed: Jan. 15, 2002

(65) Prior Publication Data

US 2002/0108599 A1 Aug. 15, 2002

(30) Foreign Application Priority Data

Feb. 9, 2001 (JP) ..... 2001-034686

(51) Int. Cl.[7] ..... F01M 1/02
(52) U.S. Cl. ..... 123/196 R; 123/198 C
(58) Field of Search ..... 123/198 R, 198 C, 123/196 R, 90.31, 192.2

(56) References Cited

U.S. PATENT DOCUMENTS 4,993,374 A * 2/1991 Okui ..... 123/196 R
5,184,582 A 2/1993 Okui et al. ..... 123/90.31
5,860,402 A * 1/1999 Sakurai et al. ..... 123/196 R
6,196,166 B1 * 3/2001 Yonezawa ..... 123/41.01

FOREIGN PATENT DOCUMENTS

JP 09 329033 A 12/1997
JP 2000-205066 7/2000

* cited by examiner

*Primary Examiner*—Willis R. Wolfe
(74) *Attorney, Agent, or Firm*—Ernest A Beutler

(57) ABSTRACT

A compact engine assembly employing an auxiliary shaft that drives engine accessories that are disposed on opposite sides of its rotational axis by separate flexible transmitters so as to reduce eccentric loading. Also, the drive pulleys for the accessories are disposed inwardly from one end of the engine so as to maintain a relatively short overall length as well as permitting a narrow width for the engine. An engine oil pump positioned within an engine end wall is also driven from the auxiliary shaft.

19 Claims, 2 Drawing Sheets

AUXILIARY EQUIPMENT IN AN ENGINE

BACKGROUND OF INVENTION

This invention relates to an auxiliary equipment arrangement in an engine and more particularly to an improved drive arrangement for driving engine auxiliaries from an intermediate shaft of the engine.

There has been proposed a type of engine that has an intermediate shaft which is driven off a location between the ends of the main crankshaft and which itself drives a plurality of accessories. Such an arrangement is shown in Japanese Published Application 2000-205066, published Jul. 25, 2000.

With this arrangement, a plurality of accessories is disposed around a pulley at one end of the intermediate shaft of the engine. These accessories all are driven by a single serpentine flexible transmitter. As a result of this arrangement, the bearings on the intermediate shaft are loaded primarily on only one side of the rotational axis of the shaft causing high loadings on its bearings, particularly those adjacent the driving pulley. In addition, it is necessary to place idlers or further accessories close together on the opposite side of the engine in order to maintain a substantial contact of the flexible transmitter with its driving pulley. This results in not only high bearing loads, but also in increased weight and size of the engine in order to accommodate their loads. In addition, this driving arrangement is disposed outwardly of one end of the engine and thus, adds to the overall length of the engine.

It is, therefore, a principal object to this invention to provide an improved accessory drive for driving engine accessories from an intermediate shaft of the engine.

In addition to those external accessories for the engine, there are also a number of internal accessories that are driven from the engine. An examples of such internal accessories is the oil pump, which collects oil from the oil tank or crankcase and circulates it to the various components of the engine for their lubrication. Frequently, this oil pump is located in the crankcase and is driven from the engine crankshaft. One problem with this type of location is that the engine oil pump is very difficult to obtain for servicing and frequently even the engine must be removed from the chassis of the vehicle to service the oil pump.

It is, therefore, a further object of this invention to provide an improved oil pump drive for an engine wherein the engine oil pump can be easily removed for servicing.

It is a further object to this invention to provide an improved arrangement for driving the oil pump directly from an end of the intermediate shaft.

SUMMARY OF INVENTION

This invention is adapted to be embodied in an internal combustion engine having a cylinder block with a plurality of aligned cylinder bores, each of which contains a piston for driving a crankshaft journal led in a crankcase formed at the lower end of the cylinder block. An auxiliary shaft is journal led for rotation about an auxiliary shaft axis at one side of the cylinder block and is driven by the crankshaft. A pair of pulleys is fixed at one end of the auxiliary shaft. A pair of engine accessories is mounted at the one side of the cylinder block on diametrically spaced sides of the auxiliary shaft axis. First and second flexible transmitters drive the pair of engine accessories from respective ones of the pair of pulleys.

In accordance with another feature of the invention, the crankshaft is journal led by at least two bearings positioned in opposite end walls of the engine and at least one of the auxiliary shaft pulleys is disposed inwardly of at least one of the engine end walls so as to reduce the overall length of the engine.

Another feature of the invention is adapted to be embodied in an internal combustion engine having a cylinder block with a plurality of aligned cylinder bores each containing a piston driving a crankshaft journal led in a crankcase formed at a lower end of the cylinder block. An auxiliary shaft is journal led for rotation about an auxiliary shaft axis at one side of the cylinder block and is driven by the crankshaft. An engine accessory is driven by the auxiliary shaft externally of a body of the engine. An oil pump is driven from the end of the auxiliary shaft adjacent the external engine accessory.

DETAILED DESCRIPTION

Figure 1:
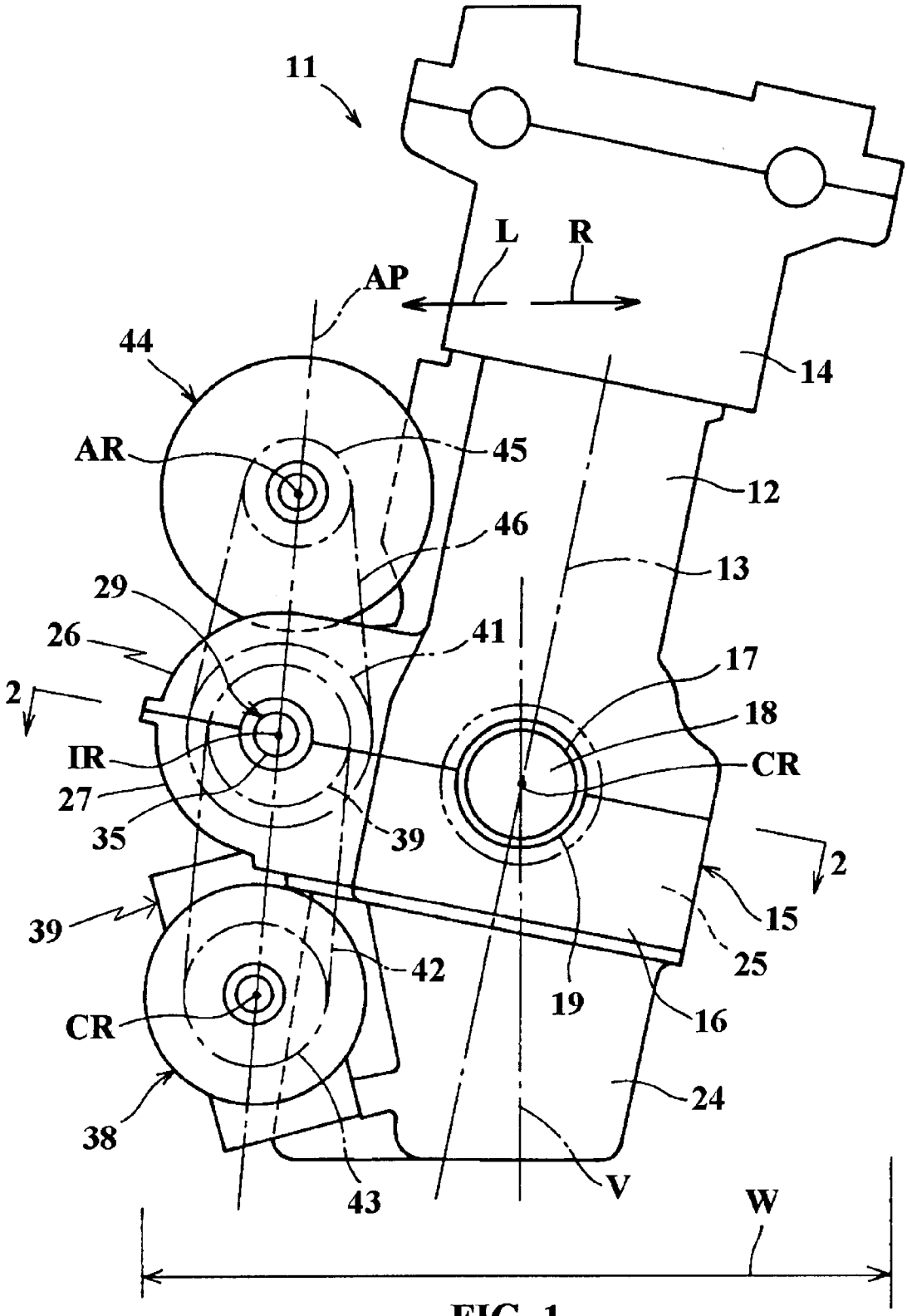
FIG. 1 is a front elevational view of an internal combustion engine constructed in accordance with an embodiment of the invention.

Referring now in detail to the drawings, an internal combustion engine constructed in accordance with an embodiment of the invention is identified generally by the reference numeral 11. The engine 11, because of its compact nature, is particularly adapted for use in transverse positioning within the engine compartment either at the front or rear of an automotive vehicle. Of course, other utilizations for the engine are possible, such as in motorcycles, as are other engine placements in an associated engine compartment.

The engine 11 is comprised of a cylinder block, indicated generally by the reference numeral 12 and which has a number of cylinder bores which do not appear, but which have axes indicated by the line 13. In the specific embodiment illustrated, the engine may be of the five cylinder, in-line type but, of course, any suitable number of cylinders may be employed.

As may be seen in FIG. 1, the cylinder block 12 is disposed so that the cylinder bore axes 13 lie in a common plane that is disposed at an acute angle to a vertical plane indicated at V in FIG. 1. In other words, the cylinder block 12 is canted slightly to the right as shown by the directional arrows in this figure.

A cylinder head assembly 14 of any known type is fixed to the cylinder block 12 and is provided with a valving system comprised of intake and exhaust valves that control the flow of air to the combustion chambers and the discharge of exhaust gases there from. Since any type of valve mechanism may be employed as well as the associated induction and exhaust systems, this structure is not illustrated, nor are the pistons which reciprocate in the cylinder bores.

Figure 2:
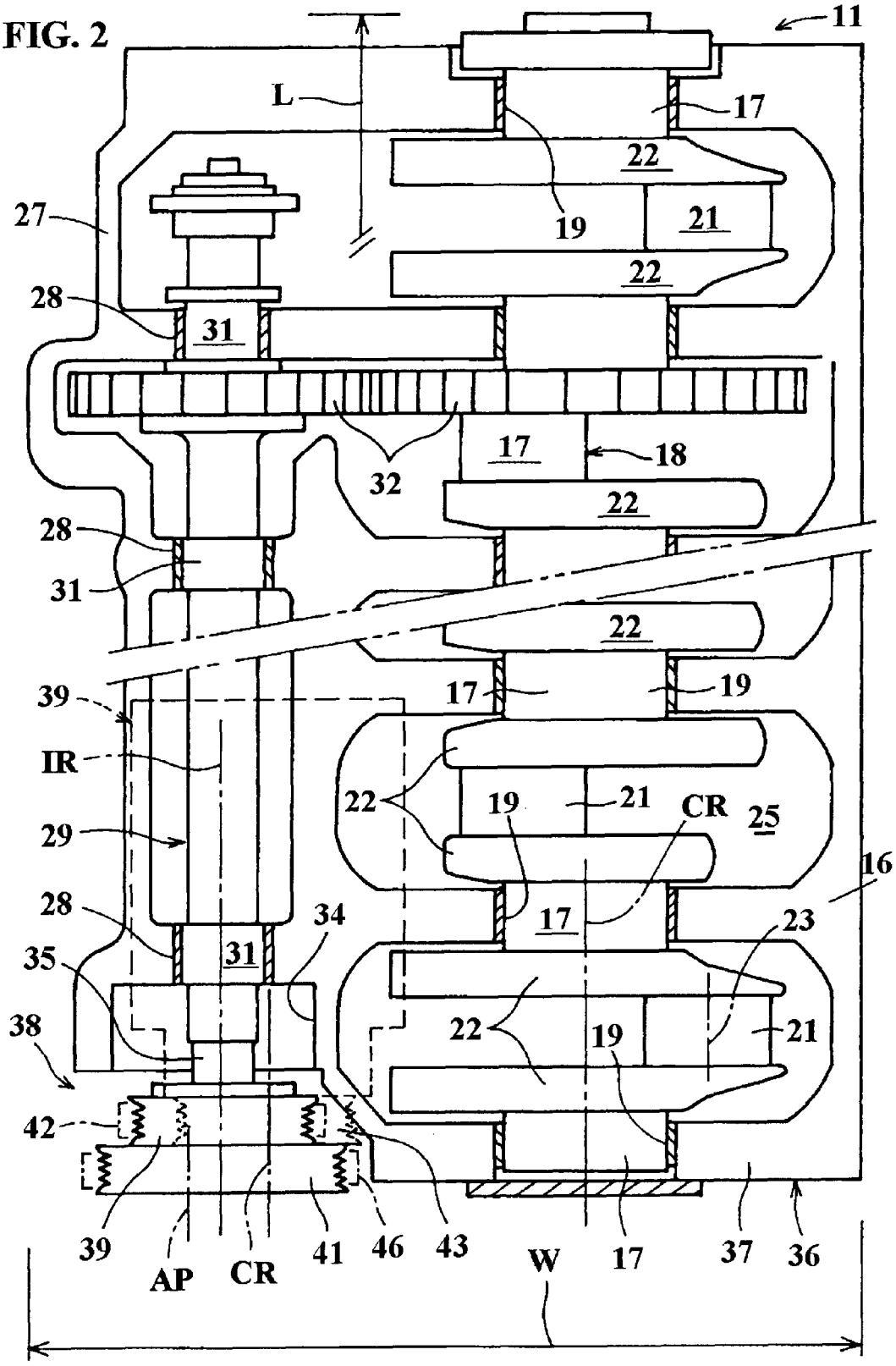
FIG. 2 is an enlarged cross sectional view taken along the line 2—2 of FIG. 1.

Beneath the cylinder block 12 there is provided a crankcase assembly, indicated generally by the reference numeral 15 which is comprised of a crankcase member 16 which is affixed to the cylinder block 12 and that journals the main bearing portions 17 of a crankshaft, indicated generally by the reference numeral 18. These main bearings are shown in FIG. 2 and are indicated by the reference numeral 19.

The rotational axis of the crankshaft is indicated at CR in the drawings and it will be seen that this coincides with the point where the plane containing the cylinder bore axes 13 intersect the vertical plane V.

Crank journals 21 are formed by pairs of throws 22 of the crankshaft 19 and journal the big ends of connecting rods, the small ends of which are connected to the pistons in the individual cylinder bores for driving the crankshaft 18 in a well known manner. These throws have rotational axes 23, one of which is identified in FIG. 2.

The crankcase assembly 15 is completed by an oil pan 24 that is affixed to the lower end of the crankcase member 16 and which defines an oil reservoir and encloses the crankcase cavity 25 in which the crankshaft 18 is journal led.

The left side of the cylinder block 12 and crankcase member 16 are formed with respective extensions 26 and 27 that form surfaces that receive bearings 28 for journaling bearing portions of an auxiliary or intermediate shaft, indicated generally by the reference numeral 29. These intermediate shaft bearing portions are indicated by the reference numeral 31. Thus the intermediate shaft 29 is journaled for rotation about an axis that is parallel to the rotational axis CR of the crankshaft 18. This intermediate shaft rotational axis is indicated by the reference character IR.

One of the throws 22 of the crankshaft 18 is formed with in integral gear that meshes with a gear formed on the intermediate shaft, these gears each being indicated by the reference numeral 32. Thus, the intermediate shaft 29 is driven at the same rotational speed as the crankshaft 18 but in an opposite direction. If desired, one of more balance masses 33 may be formed on the intermediate shaft 29 between adjacent pairs of the bearing portions 31 for assisting in engine balancing.

Also, the cylinder block and crankcase member portions 26 and 27 define at one end portion thereof a cavity 34 in which a pumping member (not shown) of an oil pump is positioned. This pumping member is driven by an intermediate shaft portion 35 and receives lubricant from the crankcase 25 and circulates it to the engine through suitable passages formed in the crankcase member 16 and the cylinder block 12. This includes passages for lubricating the bearings 19 and 28. The oil pump may be of any known type such as a gerotor pump or the like and the cavity 34 is closed by a suitable cover plate. Thus, this provides a compact construction and an easily serviced oil pump.

It should be noted that the portions 26 and 27 of the cylinder block and crankcase member are recessed from a front wall 36 of the engine which forms a flange 37 in which the front main bearing 19 for the crankcase bearing portion 17 is positioned. This defines a recess, indicated generally by the reference numeral 38 in which an accessory drive mechanism, now to be described, is positioned.

A pair of pulleys comprised of a smaller diameter, inner pulley 39 and a larger diameter, outer pulley 41 are fixed to this end of the intermediate shaft 29. These pulleys 39 and 41 are located substantially within the recess 38 and substantially rearwardly of the front engine wall 39.

A first flexible transmitter 42 is engaged with the smaller diameter pulley 39 and drives a further pulley 43 of an engine accessory such as an air conditioning compressor, indicated generally by the reference numeral 39. This engine accessory 39 is disposed on the diametrically lower side of the intermediate shaft rotational axis IR. The axis of rotation of the air conditioning compressor is indicated, as CR and it will be seen that this axis is offset toward the vertical plane V from the rotational axis IR of the intermediate shaft. This permits the air conditioning compressor 39 to be tucked closely within a recess formed at the lower side of the oil pan 24, as seen in FIG. 1, and permits a relatively narrow width W for the engine in the fore/aft direction of the associated vehicle.

A further engine accessory, such as an alternator 44, is disposed above the rotational axis IR of the intermediate shaft and is provided with a driving pulley 45 that is driven by a drive belt 46 that is trained around it and around the larger pulley 41 of the intermediate shaft 29. The rotational axis AR of the alternator 44 lies on a plane AP that passes through the axes AR, IR and CR and is disposed adjacent to the cylinder block but further from the plane 13 containing the cylinder bore axes than the air conditioning compressor 39. As a result, the construction can be kept quite compact.

Because the pulleys 39 and 41 are spaced primarily inwardly from the engine end wall 36, the overall length of the engine L may be kept quite compact as well as the narrow width W. Also, since the two pulleys are driven from the intermediate shaft 29 on opposite sides of its rotational axis IR, the bearing loads are more uniform and the bearings 28 may be made smaller than with the prior art type of construction.

Thus, from the foregoing description it should be readily apparent that the described engine construction is not only compact but also minimizes loadings on the engine and the accessory drives. Of course, the foregoing description is that of a preferred embodiment of the invention and various changes and modifications may be made without departing from the spirit and scope of the invention, as defined by the appended claims.

What is claimed is:

1. An internal combustion engine having a cylinder block with a plurality of aligned cylinder bores each containing a piston driving a crankshaft journalled in a crankcase formed at a lower end of said cylinder block, an auxiliary shaft journalled for rotation about an auxiliary shaft axis at one side of said cylinder block and driven by said crankshaft, a pair of pulleys fixed at the same one end of said auxiliary shaft, a pair of engine accessories mounted at said one side of said cylinder block on diametrically spaced sides of said auxiliary shaft axis, and first and second flexible transmitters driving said pair of engine accessories from respective ones of said pair of pulleys.

2. An internal combustion engine as set forth in claim 1, wherein the engine accessories are disposed one above the other.

3. An internal combustion engine as set forth in claim 2, wherein one of the engine accessories is disposed above the auxiliary shaft axis.

4. An internal combustion engine as set forth in claim 3, further comprising an oil pump driven from the end of the auxiliary shaft adjacent the pair of pulleys.

5. An internal combustion engine as set forth in claim 4, wherein the oil pump is positioned within an end wall of said engine inwardly of the pulleys.

6. An internal combustion engine as set forth in claim 5, wherein the auxiliary shaft is journalled in the engine end wall adjacent to the oil pump.

7. An internal combustion engine as set forth in claim 1, wherein the auxiliary shaft is driven from the crankshaft at a position between the ends of the crankshaft.

8. An internal combustion engine as set forth in claim 7, wherein the auxiliary shaft is driven from the crankshaft at a position between the connection of two of the pistons to the crankshaft.

9. An internal combustion engine as set forth in claim 8, further comprising an oil pump driven from the end of the auxiliary shaft adjacent the pair of pulleys.

10. An internal combustion engine as set forth in claim 9, wherein the oil pump is positioned within an end wall of said engine inwardly of the pulleys.

11. An internal combustion engine as set forth in claim 10, wherein the auxiliary shaft is journalled in the engine end wall adjacent to the oil pump.

12. An internal combustion engine as set forth in claim 1, wherein the crankshaft is journalled by at least two bearings positioned in opposite end walls of the engine and at least one of the auxiliary shaft pulleys is disposed inwardly of at least one of said engine end walls.

13. An internal combustion engine as set forth in claim 12, wherein both of the auxiliary shaft pulleys is disposed at least partially inwardly of at least one of the engine end walls.

14. An internal combustion engine as set forth in claim 13, further comprising an oil pump driven from the end of the auxiliary shaft adjacent the pair of pulleys.

15. An internal combustion engine as set forth in claim 14, wherein the oil pump is positioned within an end wall of said engine inwardly of the pulleys.

16. An internal combustion engine as set forth in claim 15, wherein the auxiliary shaft is journalled in the engine end wall adjacent to the oil pump.

17. An internal combustion engine having a cylinder block with a plurality of aligned cylinder bores each containing a piston driving a crankshaft journalled in a crankcase formed at a lower end of said cylinder block, an auxiliary shaft journalled for rotation about an auxiliary shaft axis at one side of said cylinder block and driven by said crankshaft, an engine accessory driven by said auxiliary shaft externally of a body of said engine, and an oil pump driven from the end of the auxiliary shaft adjacent said external engine accessory.

18. An internal combustion engine as set forth in claim 17, wherein the oil pump is positioned within an end wall of said engine inwardly of the drive for the external engine accessory.

19. An internal combustion engine as set forth in claim 18, wherein the auxiliary shaft is journalled in the engine end wall adjacent to the oil pump.

* * * * *